United States Patent [19]

Waas

[11] 4,063,428

[45] Dec. 20, 1977

[54] METHOD OF DEFLECTING ICE AT UPRIGHT COLUMNS SUBMERGED IN WATER OF STATIONARY OR FLOATING STRUCTURES IN MARINE AREAS IN WHICH THE OCCURENCE OF ICE MAY BE EXPECTED, AND ICE DEFLECTOR ASSEMBLY THEREFOR

[76] Inventor: Heinrich Waas, Am Stadtwald 50, Bonn-Bad 5300 Godesberg, Germany

[21] Appl. No.: 717,135

[22] Filed: Aug. 24, 1976

[30] Foreign Application Priority Data

Aug. 26, 1975 Germany ..... 2537918
Aug. 12, 1976 Germany ..... 2636334

[51] Int. Cl.[2] ..... E02B 15/02; B63B 35/12

[52] U.S. Cl. ..... 61/102; 61/1 R; 114/40

[58] Field of Search ..... 61/1 R, 63, 86, 102; 114/40, 41, 42

[56] References Cited

U.S. PATENT DOCUMENTS

| | | | |
|---|---|---|---|
| 3,045,628 | 7/1962 | Waas et al. | 114/40 |
| 3,669,052 | 6/1972 | Schirtzinger | 61/1 R X |
| 3,693,360 | 9/1972 | Holder | 114/42 X |
| 3,759,046 | 9/1973 | Anders | 61/63 X |
| 3,807,179 | 4/1974 | Stone | 61/1 R |

FOREIGN PATENT DOCUMENTS

| | | | |
|---|---|---|---|
| 569,772 | 1/1959 | Canada | 114/40 |

*Primary Examiner*—Dennis L. Taylor
*Attorney, Agent, or Firm*—Toren, McGeady and Stanger

[57] ABSTRACT

A method of deflecting ice for protecting upright legs of stationary or floating marine structures such as marine offshore drilling platforms or the like against drift ice by suspending a heavy mass along the leg of the structure in the vicinity of the water surface and oscillating this mass so that the oscillating mass periodically hits ice adjacent the leg of the structure whereby the oscillations of the mass are generated within the oscillating mass and the resultants of the active and reactive forces and the center of gravity of a semi-cross-sectional area of the oscillating mass substantially coincide along a vertical line spaced from and substantially parallel to the leg of the structure. The ice deflector assembly includes an annular or U-shaped oscillating body suspended about the leg of the protected structure, the body housing internal oscillation generating means for generating vertical and/or horizontal oscillations of the body.

13 Claims, 7 Drawing Figures

METHOD OF DEFLECTING ICE AT UPRIGHT COLUMNS SUBMERGED IN WATER OF STATIONARY OR FLOATING STRUCTURES IN MARINE AREAS IN WHICH THE OCCURENCE OF ICE MAY BE EXPECTED, AND ICE DEFLECTOR ASSEMBLY THEREFOR

The present invention relates to a method of deflecting ice at upright columns submerged in water of stationary or floating structures in marine areas in which the occurrence of ice may be expected, and an ice deflector assembly therefor.

In marine areas in which there exists the risk of floating ice as e.g. in arctic seas the columns of stationary structures such as column or pillar mounted quais, or of floating structures such as semisubmersible drilling platforms quite frequently run the risk of being hit by drifting ice floes and must therefore be designed to withstand rather high horizontal thrusts, and this necessarily leads to rather unwieldy and expensive designs. Additionally, floating structures operating in open seas are usually of a design that precludes service in marine areas in which the occurrence of ice may be expected such as in arctic seas.

By the U.S. Pat. No. 3,807,179 has already been proposed an ice deflector assembly including an oscillating mass in the form of an annular body surrounding the column whereby this mass may be oscillated in the longitudinal direction of the column, i.e. upwardly and downwardly. Toward this purpose, various designs have been proposed. A characteristic that is common to all of these prior art designs is that the oscillation generator means are mounted exteriorly of the columns and include hydraulically or pneumatically operated piston cylinder assemblies disposed about the periphery of the columns. These piston cylinder assemblies are rigidly mounted on the columns of the structure, and the piston rods thereof are connected to the annular body. The mechanism serves to generate breaking forces that act on the ice from below. Since in all of these prior art designs the actuating means are arranged exteriorly of a column of the structure or respectively exteriorly of the annular body, these designs are highly susceptible to malfunctions or breakdown since the external devices may easily become ice locked, and removing the ice is a very time consuming operation for which additional technical aids are required.

Although in one of these heretofore known designs the annular body is actuated into performing vertical oscillations by means of the cylinder piston assemblies, there arise several drawbacks. The piston cylinder assemblies are rigidly mounted on the column, with the result that the reaction forces constitute vertical forces applied to the column, and the column is thereby oscillated. These oscillations are especially disadvantageous in floating semisubmersible structures since these oscillations are being transmitted to the whole system, i.e. the overall structure. Even in stationarily mounted structures there are encountered drawbacks insofar as there are either required additional sea floor anchoring means or there is always the risk that the structures break loose from the anchoring means. With high drift velocities of the ice, especially unfavorable oscillation conditions are encountered. This is due to the fact that an ice sheet must be broken at a very high thrust sequence in order to avoid that the unbroken ice sheet substantially contacts the annular body. The vertical oscillation frequency of the annular body must therefore be rather elevated. Since the reaction forces increase by the square of the frequency, high oscillatory stresses will be generated with high ice drift velocities that are in any case potentially destructive for any stationary or floating structure intended to operate at a fixed location. The stresses that may be encountered under these conditions may be appreciated when looking at the magnitude of the periodical vertical force required for arctic ice of approximately 1 m (3 feet ) thickness: The force of this oscillation amplitude exceeds 100 tons. Additionally, drifting ice pressing laterally against the piston rods of the piston cylinder assemblies may easily disturb or damage the actuator means.

It is an object of the present invention to provide a novel and improved method and apparatus for deflecting ice at upright columns submerged in water of stationary or floating structures in marine areas in which the occurrence of ice may be expected.

It is another object of the present invention to provide method and apparatus of the above type that do not transmit oscillations to the structure, furthermore allow to achieve an improved ice-breaking effect and keep the column free from pressures exerted by drifting ice.

For achieving these objects, the present invention proposes a method of deflecting ice as stated at the outset of the present specification wherein this method comprises the steps of arranging the mass about the entire circumference of the columns or about part of the column circumference, oscillating the mass so that the mass may act on ice adjacent the columns from above whereby the resultant of the oscillatory forces and the resultant of the reaction forces exerted by the ice and directed upwardly in a vertical direction against the oscillating mass and the center of gravity of a semi-cross sectional area of the oscillating mass substantially coincide along a vertical line.

The present invention furthermore relates to a method of deflecting ice wherein the mass disposed about part of the circumference or about the entire circumference of the columns is oscillated, the oscillation includes a vertical component and a horizontal component acting against the drifting ice, the vertical component being selected to produce an acceleration exceeding gravity acceleration, and the horizontal component being controlled so as to counter-balance forces applied by the drift ice to the columns.

In accordance with another aspect of the present invention, the mass is being oscillated in vertical and horizontal directions so that the resultants of the oscillatory vertical forces and the center of gravity of a semi-cross-sectional area of the oscillating mass substantially coincide along a vertical line whereas the resultant of the horizontal oscillatory forces is at about the level of the ice sheet and adapted to be orientated in the horizontal plane in a direction opposite the direction of ice drift.

The present invention furthermore proposes an ice deflector assembly wherein the oscillation generator is arranged within an internal cavity of the annular body type mass, the annular body includes a conically tapered outer wall portion facing, in the non-active condition of the assembly, the upper surface of the water or of a sheet of ice respectively, the conically tapered outer wall portion extending from a point slightly above the surface of the water and tapered in a downward direction so that the resultant of the oscillatory forces, the resultant of the reaction forces generated by the ice and directed upwardly in a vertical direction against the annular body, and the center of gravity of a semi-cross-sectional area of the annular body substantially coincide along a vertical line.

The annular body may comprise a relatively small diameter cylindrical sleeve having an outer wall surface consisting of an upper downwardly and outwardly flaring conical portion extending up to a point slightly above the water line, and an adjacent lower downwardly and inwardly extending conical portion.

The oscillation generator for the annular body consists of a conventional imbalance machine mounted within the annular body.

The invention furthermore proposes an ice deflector assembly wherein a clearance is provided between the column and the annular body, the annular body surrounds the column and the oscillation generator includes means for generating horizontal oscillations to generate tilting movements of the annular body whereby the resultant of the oscillatory vertical forces and the center of gravity of a semi-cross sectional area of the annular body substantially coincide along a vertical line whereas the resultant of the oscillatory horizontal forces is about at the level of the ice sheet and adapted to be orientated in the horizontal plane in a direction opposite the direction of ice drift.

The method of deflecting ice and the ice deflector assembly of the present invention allow to protect columns of stationary or floating structures, disposed in marine areas in which the occurrence of ice may be expected, against horizontal compressive forces exerted by the ice. These horizontal compressive forces exerted by the ice against the columns are reduced or respectively inactivated by the masses oscillating about the columns so that damage to the columns is avoided and expensive column designs such as reinforcements and the like are no longer required. By generating vertical oscillatory pressure forces about the columns a pressure may be exerted on the ice in exactly this region in which ice moves towards the columns. Particularly floating structures such as drilling platforms provided with ice deflector assemblies in accordance with the present invention may be operated anywhere, i.e. in marine areas free from ice and in marine areas in which the occurrence of drift ice may be expected, without requiring expensive modifications. When operating the structure in marine areas free from ice, the annular body may be raised into positions above the water line. Structures already in operation may be readily and at low cost fitted with ice deflector assemblies of the present invention.

According to the method and the ice deflector assembly of the present invention, the annular body may be oscillated in vertical and horizontal directions by actuating the mass or the annular body respectively to perform ellipsoid type oscillations wherein one axis of the ellipsoid is vertical and the other axis extends horizontally in the direction of ice drift. The direction of rotation of the elliptic oscillation may be selected to that the maximum of the vertical periodical force that is directed downwardly toward the ice sheet will coincide with the maximum of the horizontal periodical velocity oriented in the direction of the ice drift. This achieves what may be termed a climbing effect of the annular body and a certain forward thrust. The annular body, therefore, may not only oscillate in the vertical direction but likewise in horizontal directions, and the latter oscillations consist of oscillations within a plane perpendicular to the vertical axis of the column and coinciding with the plane of thrust of the drift ice. The annular body thus generates a force which is opposed the force of the drifting ice whereby the annular body need not be supported by the column. In this manner, the annular body effectively reduces the pressure exerted by the ice against the column. In accordance with the present invention, there is a sufficient clearance between the annular body and the column to keep the column free from horizontal oscillations of the annular body and to avoid tilting oscillations of the annular body generated by lateral fluctuations of the upwardly directed reaction forces of the ice from being transmitted to the column.

In accordance with another characteristic of the present invention, the annular body is resiliently mounted at the column wherein the annular body comprises a cylindrical sleeve having an inner cylindrical wall surface of a diameter larger than the outer diameter of the column and slide and guide means are provided in the space between the column and the annular body, this slide and guide means consisting of resiliently mounted pneumatic rubber tires or the like.

Apart from the means for oscillating the annular body in vertical direction, there are provided horizontal oscillation generator means within the internal cavity of the annular body, and these horizontal oscillation generator means may consist of conventional imbalance machines. The oscillation generator means may include eccentric wheels adapted to rotate synchronously. The eccentric wheels of the vertical oscillation generator means rotate in phase whereby one pair of wheels rotates in one direction of rotation, and the other pair of wheels rotates in the opposite direction of rotation. The eccentric wheels of the horizontal oscillation generator means are adapted to be driven in various mutual phase relationships and in different phase relationships with respect to the eccentric wheels of the vertical oscillation generator means, allowing to adapt magnitude and direction of the horizontal thrust generated by these means to magnitude and direction of the ice drift in thus substantially cancelling the forces of the ice drift directed against the column. For avoiding that the forces of the drifting ice and the forces exerted by the horizontal imbalance machines cannot exert any substantial additional tilting moments to the annular body, the horizontally effective parts of these imbalance machines are arranged within a plane substantially coinciding with the plane of the ice sheet.

In accordance with another characteristic of the present invention the oscillating mass adapted to perform vertical and/or horizontal oscillations with respect to the column may comprise a U-shaped body housing the oscillation generator means. The usage of an U-shaped body is of particular interest since an ice deflector assembly of this type allows to provide already existing structures permanently or temporarily with ice deflector means in accordance with the present invention.

In the following, the present invention will be explained more in detail with reference to several preferred embodiments of an ice deflector assembly for upright columns submerged in water of stationary or floating structures in marine areas in which the occurrence of ice may be expected. In the drawings FIG. 1 is a partly sectional vertical elevational view of an ice deflector assembly in accordance with the present invention, the assembly including an annular body adapted to be oscillated upwardly and downwardly in vertical direction along the columns of a structure;

Figure 1:
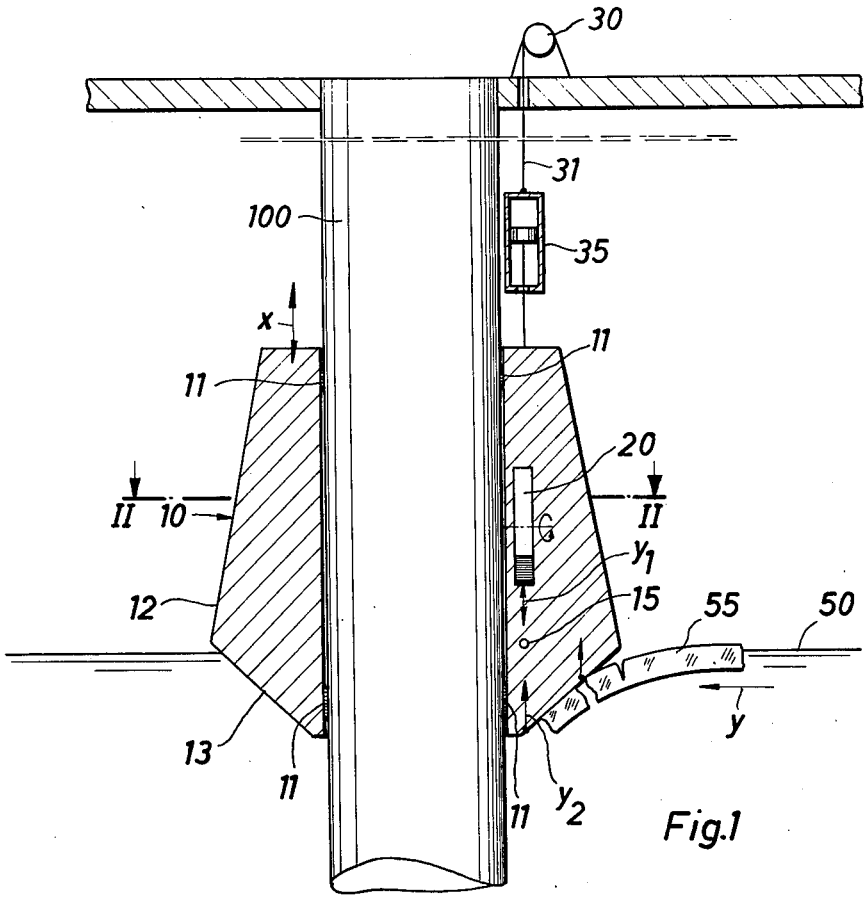
Figure 2:
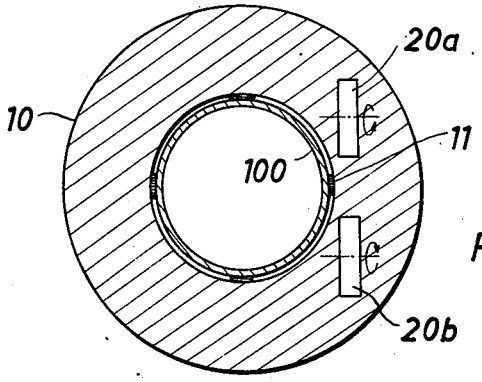
FIG. 2 is a horizontal sectional view along line II—II of FIG. 1.
Figure 3:
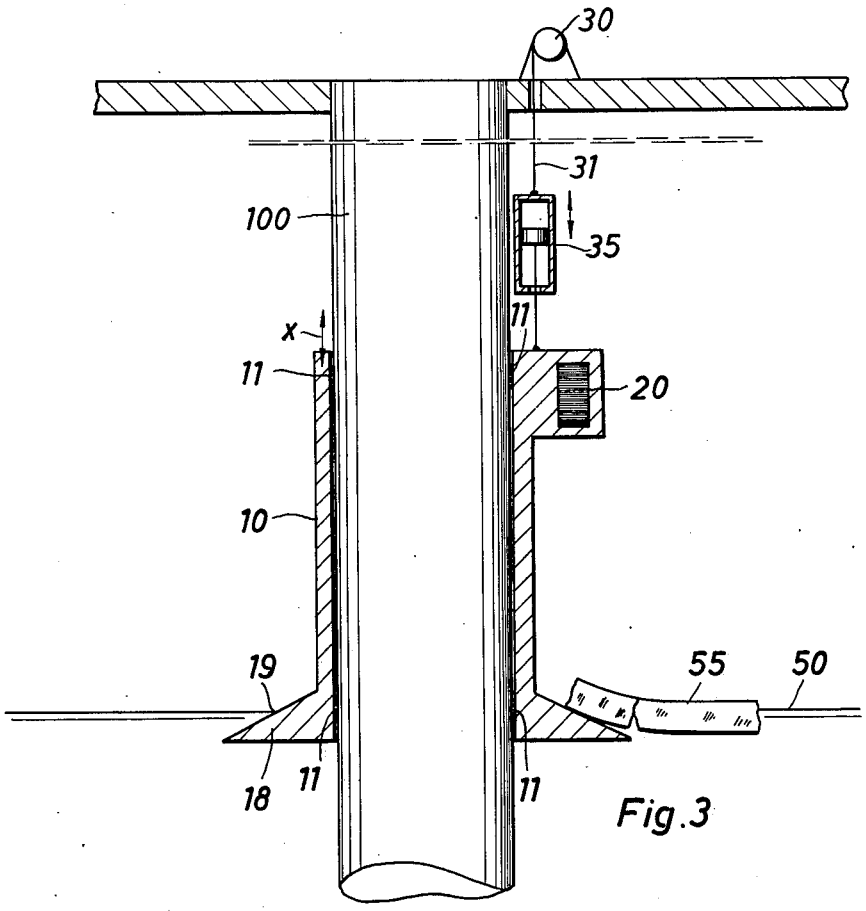
FIG. 3 is a partly sectional vertical elevational view of another embodiment of an ice deflector assembly in accordance with the present invention.

Referring to FIGS. 1 - 3, there is shown a column 100 of a structure (not shown) disposed in a marine area in which the occurrence of ice may be expected. In FIG. 1 and 3, the surface of the water is indicated at 50, and an ice sheet at 55. The horizontal thrust exerted by the ice sheet 55 against the column 100 is indicated by the arrow *y*.

An annular body 10 is mounted about the column 100 and is adapted to be moved upwardly and downwardly with respect to the column. This annular body 10 may define a full circle entirely encircling the column or may be an annular structure encircling the column over less than 360°. Slide or guide tracks schematically indicated at 11 in FIG. 1 serve to guide the annular body 10 for upward and downward movements along the column 100. The slide or guide tracks 11 are adapted to allow sliding movements of the annular body 10 with relatively small frictional resistances. As may be seen in the embodiment of FIG. 3, the annular body 10 consists of a cylindrical sleeve of a relatively small outer diameter.

The annular body 10 includes a downwardly conically tapered portion 13 facing the water surface or the ice sheet respectively. This conical portion 13 extends from a point slightly above the water surface 50, as may be seen in FIG. 1. The outer wall surface of the annular body 10 may either extend in a direction parallel to the outer surface of the column 100, or may consist of a downwardly and outwardly flaring conical surface 12, as shown e.g. in FIGS. 1 and 4.

For oscillating the annular body 10 upwardly and downwardly in the vertical direction, there is provided a conventional oscillation generator such as an imbalance machine 20. The annular body 10 is oscillated in the direction indicated by the double headed arrow *x*. The oscillation generator 20 is arranged within the annular body 10 in a predetermined location selected so that the resultant $Y_1$ of the oscillatory forces and the resultant $Y_2$ of the reaction forces exerted by the ice and directed upwardly against the annular body 10 and the center of gravity 15 of a semi-cross-sectional area of the annular body 10 substantially coincide along a vertical line. As may be seen in FIG. 2, the oscillation generator 20 may consist of a pair of rotating wheels 20*a*, 20*b*.

For adjusting the annular body 10 at an appropriate level, the annular body 10 is connecged by a cable 31 to a winch 30, and this cable connection includes a resilient coupling 35 consisting of a hydraulically or pneumatically operated system.

The upwardly and downwardly oscillating annular body 10 hits the upper surface of the approaching ice sheet 55. As may be seen from the embodiment shown in FIG. 3, the annular body may likewise be employed to act on the ice sheet 55 from below, and the effects achieved by both the embodiments of FIGS. 1 and 3 are substantially identical. In the embodiment of FIG. 3, the annular body 10 includes, below the water line 50, an outwardly projecting annular enlarged portion 18 defining an upper conical surface 19 that projects outwardly from the outer wall surface of the annular body 10.

The winch 30 for level adjustments of the annular body 10 may of course likewise be employed for lifting the annular body 10 e.g. during periods of non-usage. In the lifted position, the annular body 10 may preferably be locked by suitable locking means (not shown).

Figure 4:
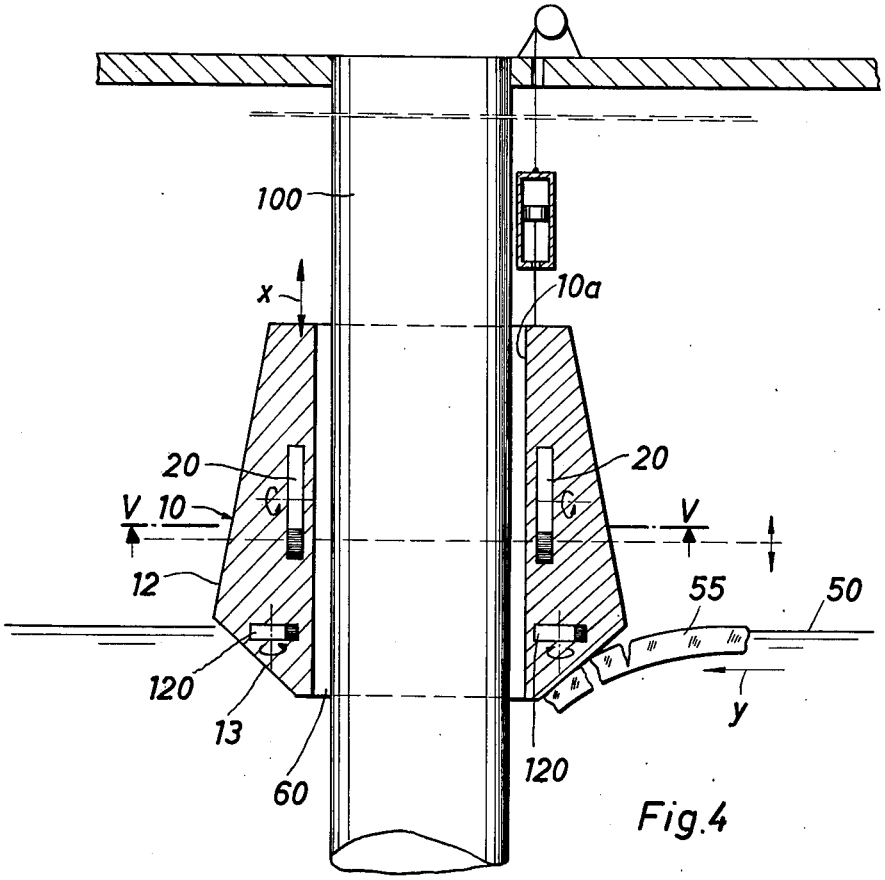
FIG. 4 is a partly sectional elevational view of still another embodiment of an ice deflector assembly.
Figure 5:
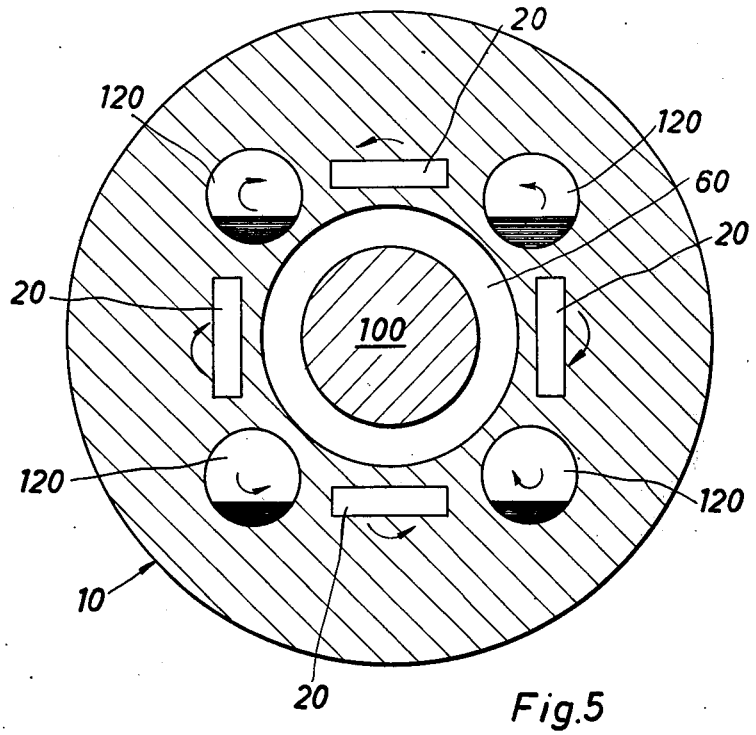
FIG. 5 is a vertical sectional view along the line IV—IV of FIG. 4.
Figure 6:
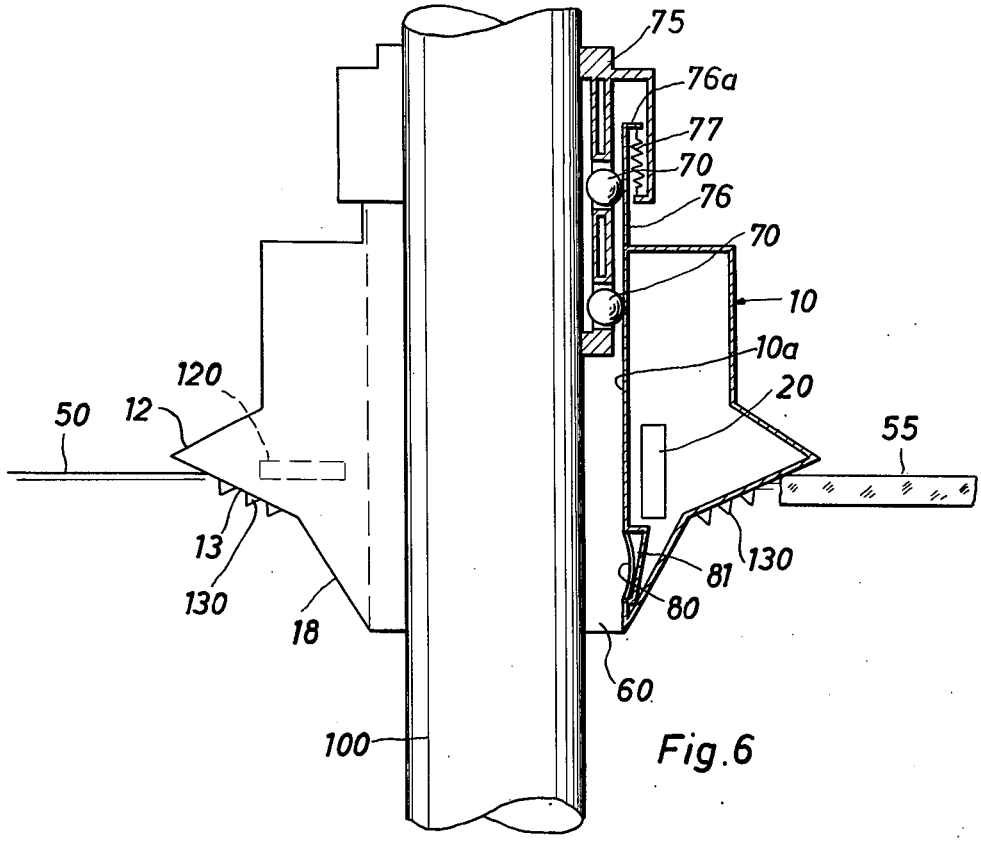
FIG. 6 is a partly sectional elevational view of still another embodiment of an ice deflector assembly of the present invention.

Referring to FIGS. 4 - 6, the reference numeral 100 designates a column of a structure not shown which may be disposed in a marine area subject to ice risk. In FIGS. 4 and 6, the water surface is indicated at 50, and the ice sheet at 55. The ice sheet 55 exerts a pressure in horizontal direction against the column 100, as indicated by the arrow *Y*.

An annular body 10 is movably mounted at the column 100 and movable upwardly and downwardly with respect to the column. The annular body 10 may consist of a ring member fully encircling the column or a ring member extending partly around the column. The annular body 10 is spaced from the column 100 by an intermediate space 60. The diameter of the annular body 10 at the inner cylindrical wall surface 10*a* thereof is much larger than the outer diameter of the column 100 (FIGS. 4 and 5).

A mounting ring 75 is securely mounted to the column 100. The mounting ring 75 extends into the space 60 between the column 100 and the annular body 10 and includes slide and guide means 70 defining bearing means for the inner cylindrical wall surface 10*a* of the annular body 10. These slide and guide means 70 consist of resilient air inflated rubber rollers or the like and are adapted to partly acccommodate oscillations of the annular body 10 so that no oscillations will be transmitted to the column 100. The mounting ring 75 may be adjusted upwardly and downwardly along the column 100, and the slide and guide means 70 thereof extend so far into the vertical range of oscillations of the annular body 10 that the inner wall surface 10*a* of the annular body 10 may bear against the rollers of the slide and guide means 70.

The annular body 10, moreover, is connected to the mounting ring 75 by vertical spring means 77. Toward this end, the inner wall surface 10*a* of the annular body 10 includes an upwardly extending tubular portion 76 including a bent portion 76*a* at its free end, as may be seen in FIG. 6. A spring 77 is connected by its one end to this bent portion 76*a*, and by its opposite end to the mounting ring 75.

The annular body 10 includes a lower downwardly and inwardly extending conical portion 13 facing the water or ice surface and extending downwardly from a point slightly above the water line 50, as shown in FIG. 4. The outer wall surface of the annular body 10 may extend in a direction generally parallel to the outer surface of the column 100, or alternately may consist of a downwardly and outwardly flaring conical portion 12.

In the embodiment of the ice deflector assembly shown in FIG. 6, the annular body 10 includes a downwardly and outwardly flaring conical portion 12 followed by a lower downwardly and inwardly extending conical portion. The lower conical portion 13 covers a greater height increment than the upper conical portion 12 and adjoins at its lower end a more tapered conical portion 18. The overall configuration of the annular body 10 of the embodiment shown in FIG. 6 is selected so that the conical portion 13 of the annular body 10 partly engages the surface of the ice 55, as shown in FIG. 6. The downwardly facing surface of the conical portion 13 of the annular body 10 engaging the ice may be provided with a plurality of concentric ribs 130 or the like of a triangular cross-section.

In order to avoid vehement water turbulence or whirls and an associated energy dissipation in the space 60 between the column 100 and the inner cylindrical wall surface 10*a* of the annular body 10 during horizontal oscillatory movements of the annular body 10, a peripheral rim 80 made of rubber resilient materials for pressure compensation is provided at the inner wall surface 10*a* in the lower region of the annular body 10. This peripheral rim 80 preferably consists of a rubber sleeve defining one wall of an air-filled cavity 81 at the inner wall surface 10*a*. In this manner, pressure variations occurring during horizontal oscillating movements of the annular body 10 will be greatly dampened by the rubber sleeve 80.

For oscillating the annular body in vertical directions, the annular body includes at least one conventional oscillation generator 20 such as an imbalance machine. The oscillating movements of the annular body 10 are generated in the direction of the double headed arrow *x* (see FIG. 4).

For oscillating the annular body 10 also in horizontal directions, the annular body 10 may furthermore comprise a non-directional horizontal oscillation generator 120, and the annular body 10 is free to perform horizontal oscillations, due to the relatively large space 60 between the annular body and the column 100.

When the annular body 10 is driven into performing vertical and horizontal oscillations, the trajectory of the annular body corresponds approximately to an ellipsoid one axis of which is vertical and the other axis of which is horizontal and coincides with the direction of ice drift. The direction of rotation is thereby selected so that the maximum of the periodical downward forces against the ice sheet occurs simultaneously with the maximum of the horizontal periodical velocities directed in the direction of ice drift. In this manner, every part of the annular body 10 performs an elliptical movement.

By the aforedescribed movement the annular body exhibits what may be termed a climbing effect since ice approaching the column 100 will be hit and crushed by the downward movement of the annular body 10 whereby simultaneously the horizontal oscillation component coinciding with the direction of ice drift will act on the ice by frictional and adhesive forces so as to push the ice in the direction of the ice drift. For increasing these frictional forces, the conical portion 13 of the annular body 10 facing the ice may be provided with a rough surface structure such as with projecting concentric ribs 130 of a triangular cross-section (see FIG. 6). The upward movement of the annular body is effected at a high acceleration so that the annular body becomes disengaged from the ice. The horizontal oscillation of the annular body against the direction of ice drift and whilst the annular body is disengaged from the ice cannot transmit any forces onto the ice (climbing effect).

The superposition of both oscillating movements results in a surprising and important effect: The horizontal thrust exerted by the drifting ice against the column may virtually be eliminated completely.

As may be seen from FIG. 5, the oscillation generator 20 for generating vertical oscillations, and the oscillation generator 120 for generating horizontal oscillations are alternately arranged within cavities of the annular body 10. The eccentric wheels of the oscillation generators 20 and 120 may rotate synchronously. The eccentric wheels of the oscillation generator 20 for generating vertical oscillations rotate in phase, whereas the eccentric wheels of the oscillation generator for generating horizontal oscillations 120 rotate at various and mutually adjustable phase relationships so that the magnitude and the direction of the horizontal forces generated by this generator may be varied.

The phase adjustment may be controlled in a manner known per se such as by means of a computer in a manner similar to maintaining exactly a predetermined position of a floating drilling platform.

For rotating the annular body 10 into the direction of ice drift, no additional mechanical actuators are required.

Figure 7:
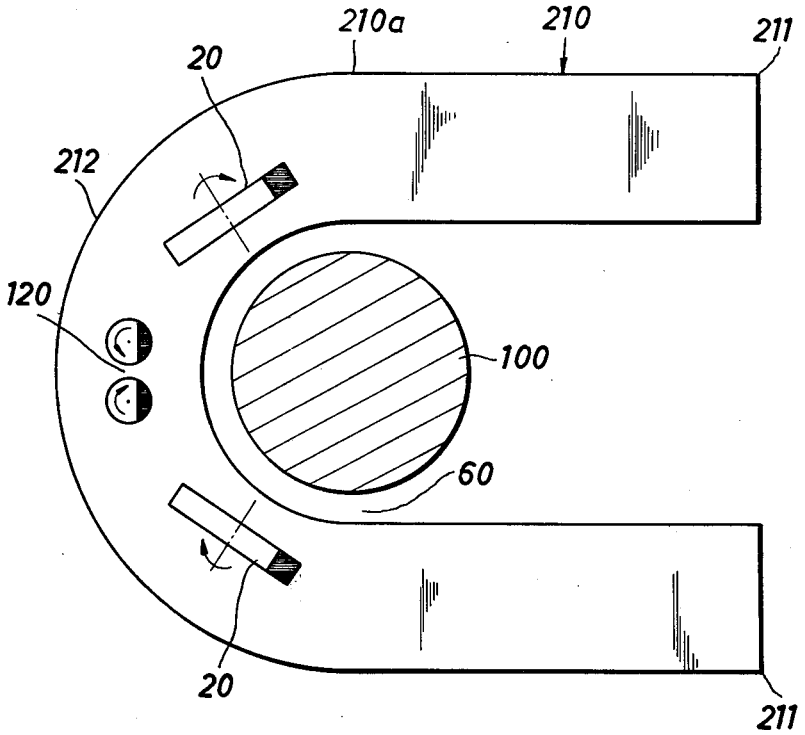
FIG. 7 is a top view of an oscillating mass in the form of an U-shaped body at the column of a structure and adapted to be oscillated upwardly and downwardly along the column.

As shown in FIG. 7, the annular body surrounding the column 100 may be replaced by an U-shaped body 210 that is spaced from the column circumference by a space 60. The U-shaped body 210 includes an outer wall surface 210*a* defining at least below the water surface a downwardly and inwardly inclined working surface (not shown). Since the ends 211 of the two legs of the U-shaped body 210 are at a greater distance from the center of the column 100 than the semi-circular peripheral edge portion 212 of the body 210, the U-shaped body 210 will automatically orientate itself in the manner of a weather vane so that the peripheral edge portion 212 will face the direction of ice drift, i.e. point into the direction of the oncoming ice.

I claim:

1. A method of deflecting ice from an upright column-like member submerged in water and forming part of a stationary or a floating structure in marine areas in which the occurrence of ice may be expected, comprising supporting a deflector having upwardly and downwardly directed deflecting surfaces about an individual column, adjusting the deflector vertically to locate the deflecting surfaces thereof in the range of the ice around the column-like member, wherein the improvement comprises generating oscillations within the deflector for oscillating the deflector in the upward and downward direction for movement relative to and separate from the column-like member, and elastically suspending the deflector about the column-like member so that the oscillating action of the deflector is not transmitted to the column-like member.

2. A method, as set forth in claim 1, including the further steps of connecting the deflector to the column-like member by means of a number of spring members, oscillating the deflector by mans of several rotating eccentric masses, driving the rotating eccentric masses at a constant speed, regulating the speed and phase of rotation of the eccentric masses so that periodically the force of the eccentric masses is such that the deflector moves upwardly separating itself from the ice around the column-like member and it counteracts the horizontal force of the ice acting on the deflector.

3. An ice deflector assembly for use with upright columns of stationary or floating structures submerged in marine areas in which the occurrence of ice may be expected, said deflector assembly comprising a deflector member positioned in at least partially encircling relationship about one of the columns, means for movably supporting the deflector member for movement in the upright direction and for positioning the deflector member in the upright direction for locating it in the range of the ice located about the columns, wherein the improvement comprises that said deflector is freely movable in all directions in the operating state, means for elastically suspending said deflector about the column which it at least partly encircles, and means incorporated within said deflector for oscillating said deflector in the vertical direction.

4. A deflector assembly, as set forth in claim 3, wherein said deflector having an upwardly extending exterior surface, a first portion of said exterior surface having an upper end and a lower end with the first portion tapering inwardly toward the column from the upper end to the lower end and the vertical dimension of the first portion from the upper end to the lower end being such that the upper end can be located slightly above the level of the water in which the ice is located while the lower end is located slightly below the lower level of the ice.

5. An ice deflector assembly, as set forth in claim 3, wherein said deflector being annular and completely encircling said column.

6. An ice deflector assembly, as set forth in claim 3, wherein said means for movably supporting said deflector comprises a cable winch, and a resilient coupling member connected at one end to said winch and at the opposite end to said collector.

7. An ice deflector assembly, as set forth in claim 3, wherein said deflector comprises an upright hollow cylinder, a first section secured to and extending outwardly from the lower end of said hollow cylinder, said first section having an upwardly facing surface tapering outwardly and downwardly from the outer surface of said hollow cylinder, a second section extending downwardly from the lower end of said first section and said second section having a downwardly facing surface tapering inwardly and downwardly from the lower end of said first section, and said means for elastically suspending said deflector comprising sliding and guiding means located between the column and said deflector for accomomodating oscillations within said deflector and preventing the transmission of the oscillations to the column.

8. An ice deflector assembly, as set forth in claim 3, including means for oscillating said deflector in the horizontal direction comprising a plurality of horizontally acting eccentric wheels, and the phases of said horizontally eccentric wheels being adjustable relative to one another.

9. An ice deflector assembly, as set forth in claim 7, wherein said means for elastically suspending said deflector comprises a mounting ring rigidly connected to and laterally encircling the column with the upper end of said mounting ring located above said deflector and extending downwardly between said column and said deflector, said sliding and guiding means mounted in said mounting ring, and a vertically extending spring connected at one end to said mounting ring and at the opposite end to said deflector.

10. An ice deflector assembly, as set forth in claim 9, wherein said deflector having a tubular section extending upwardly from the upper end thereof, the upper end of said tubular section being bent outwardly, said mounting ring laterally enclosing at least a part of said tubular section and extending vertically downwardly below the upper end of said tubular section, said spring connected at one end to said mounting ring and extending upwardly therefrom and connected at the opposite end to the outwardly bent upper end of the tubular section.

11. An ice deflector assembly, as set forth in claim 10, wherein said deflector having an inner surface spaced outwardly from said column, a peripheral rim formed of a rubber resilient material and forming a part of the inner surface of said deflector at the lower end of said deflector for dampening variations occurring during horizontal oscillating movements of the deflector.

12. An ice deflector assembly, as set forth in claim 3, wherein said deflector comprises a U-shaped body having an upwardly extending inner and outer surface, the closed portion of said U-shaped body extending around the column, the lower end of said deflector tapering downwardly and inwardly from the outer to the inner surface.

13. An ice deflector assembly, as set forth in claim 7, wherein a plurality of circumferentially extending concentric ribs being located on and projecting outwardly from said second section of said deflector, and each of said ribs having a triangular cross section.

* * * * *